US008045896B2

(12) United States Patent
Mihara

(10) Patent No.: US 8,045,896 B2
(45) Date of Patent: Oct. 25, 2011

(54) DEVELOPING DEVICE AND IMAGE FORMING APPARATUS USING THE SAME

(75) Inventor: Koichi Mihara, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 93 days.

(21) Appl. No.: 12/710,938

(22) Filed: Feb. 23, 2010

(65) Prior Publication Data

US 2010/0226689 A1 Sep. 9, 2010

(30) Foreign Application Priority Data

Mar. 6, 2009 (JP) ..... 2009-053530

(51) Int. Cl.
*G03G 15/08* (2006.01)

(52) U.S. Cl. ..... 399/254; 399/256

(58) Field of Classification Search ..... 399/254–256, 399/258, 263, 358, 359; 366/318, 320, 321, 366/323, 325.3
See application file for complete search history.

(56) References Cited

U.S. PATENT DOCUMENTS

| | | | | |
|---|---|---|---|---|
| 6,577,834 | B2 * | 6/2003 | Suzuki | 399/254 |
| 7,311,438 | B2 * | 12/2007 | Kim et al. | 366/295 |
| 7,373,092 | B2 * | 5/2008 | Tawada | 399/35 |
| 7,912,408 | B2 * | 3/2011 | Iwata et al. | 399/239 |
| 7,979,007 | B2 * | 7/2011 | Mihara et al. | 399/254 |
| 2008/0025763 | A1 * | 1/2008 | Suenami | 399/256 |
| 2010/0196058 | A1 * | 8/2010 | Mihara et al. | 399/256 |

FOREIGN PATENT DOCUMENTS

| | | | |
|---|---|---|---|
| JP | 04125577 A | * | 4/1992 |
| JP | 9-120201 A | | 5/1997 |
| JP | 10171224 A | * | 6/1998 |
| JP | 2004258237 A | * | 9/2004 |
| JP | 2005-24592 A | | 1/2005 |
| JP | 2006119549 A | * | 5/2006 |
| JP | 2008-33109 A | | 2/2008 |
| JP | 2008032983 A | * | 2/2008 |

* cited by examiner

*Primary Examiner* — Robert Beatty
(74) *Attorney, Agent, or Firm* — Birch, Stewart, Kolasch & Birch, LLP

(57) ABSTRACT

A developing device includes a developing vessel for storing a developer, a first conveying passage, a second conveying passage, a first conveying member and a second conveying member to supply toner to a photoreceptor drum. The first conveying member includes a first rotary shaft and a first multi-helically structured blade. The first multi-helically structured blade includes a first inner helical blade and ring-shaped first outer helical blade. The first inner helical blade is formed so that the radius of the helical blade varies cyclically. The second helical pitch of the first outer helical blade is smaller than the first helical pitch of the first inner helical blade. The first outer helical blade inscribes the outer periphery of the first inner helical blade at its minimum radius portions.

7 Claims, 9 Drawing Sheets

DEVELOPING DEVICE AND IMAGE FORMING APPARATUS USING THE SAME

This Nonprovisional application claims priority under 35 U.S.C. §119 (a) on Patent Application No. 2009-053530 filed in Japan on 6 Mar. 2009, the entire contents of which are hereby incorporated by reference.

BACKGROUND OF THE INVENTION (1) Field of the Invention

The present invention relates to a developing device and an image forming apparatus using the device, in particular relating to a developing device using a dual-component developer containing a toner and a magnetic carrier, for use in an image forming apparatus for forming images using the toner based on electrophotography, such as an electrostatic copier, laser printer, facsimile machine or the like, as well as to an image forming apparatus using this device.

(2) Description of the Prior Art

Conventionally, image forming apparatuses based on electrophotography such as copiers, printers, facsimile machines and the like have been known. The image forming apparatus using electrophotography is constructed so as to form an image by forming an electrostatic latent image on the photoreceptor drum (toner image bearer) surface, supplying toner to the photoreceptor drum from a developing device to develop the electrostatic latent image, transferring the toner image formed on photoreceptor drum by development to a sheet of paper or the like, and fixing the toner image onto the sheet by means of a fixing device.

Recently, in the image forming apparatuses capable of reproducing full-color and high-quality images, a dual-component developer (which will be referred to hereinbelow as simply "developer"), which can present excellent charge performance stability, is often used. This developer consists of a toner and a carrier, which are agitated in the developing device and frictionally rubbed with each other to produce appropriately electrified toner.

In the developing device, the electrified toner is supplied to a developer supporting member, e.g., the surface of a developing roller. The toner thus supplied to the developing roller is moved by electrostatic attraction to the electrostatic latent image formed on the photoreceptor drum. Hereby, a toner image based on the electrostatic latent image is formed on the photoreceptor drum.

Further, the image forming apparatus of this kind is demanded to be made compact and operate at high speeds, and it is also necessary to electrify the developer quickly and sufficiently and also convey the developer quickly and smoothly.

For this purpose, in order to disperse supplied toner promptly into the developer and provide the toner with an appropriate amount of charge, an image forming apparatus equipped with a developing device of a circulating mechanism including two developer conveying passages that form a circulative path for conveying the developer and two developer agitators that agitate the developer while conveying the developer in the developer passages has been disclosed in patent document 1 (see Japanese Patent Application Laid-open 2005-24592).

In the developing device of patent document 1, usually, auger screws are used as the developer conveying members for circulatively conveying the developer while agitating the developer inside the developer vessel. However, this configuration has suffered the problem that if the rotational speed of the augers is increased in order to raise the speed of developer conveyance, the developer near the interior wall of the developer conveying passage (the space between the auger screw and the wall) is left behind from the developer that is conveyed by the auger screw, stagnating therein. As a result, the developer's agitation performance lowers, causing the problem of toner concentration unevenness.

SUMMARY OF THE INVENTION

The present invention has been devised in view of the above problem, it is therefore an object of the present invention to provide a developing device that can prevent toner concentration unevenness without reducing the conveying speed of the developer as well as providing an image forming apparatus using this device.

According to the present invention, the developing device for solving the above problem and the image forming apparatus using this are configured as follows:

A developing device according to the first aspect of the present invention includes: a developer container for storing a developer comprising a toner and a magnetic carrier; a developer conveying passage through which the developer is conveyed in the developer container; a developer conveying member (e.g., an auger screw) disposed inside the developer conveying passage for agitating and conveying the developer in a predetermined direction; and, a developing roller which supports the developer in the developer conveying passage and supplies the toner contained in the developer to a photoreceptor drum, and is characterized in that the developer conveying member includes: a rotary shaft; and a multi-helically structured blade with helical blades formed on the periphery of the rotary shaft, the multi-helically structured blade includes: an inner helical blade arranged on the periphery of the rotary shaft; and, an outer helical blade having a ring-shaped form when viewed from the axial direction that inscribes the outer periphery of the inner helical blade, the inner helical blade is formed such that the radius of the helical blade varies cyclically, the second helical pitch of the outer helical blade is smaller than the first helical pitch of the inner helical blade, and, the outer helical blade inscribes the outer periphery at the minimum radius portions of the inner helical blade.

The developing device according to the second aspect of the present invention is characterized in that the second helical pitch is one half of the first helical pitch. The developing device according to the third aspect of the present invention is characterized in that the maximum radius of the inner helical blade is equal to the radius of the outer helical blade, and the minimum radius of the inner helical blade is within the range of 0.75 times to 0.9 times the radius of the outer helical blade.

The developing device according to the fourth aspect of the present invention is characterized in that the helical angle formed between the axis of the rotary shaft and the outer helical blade falls within the range of 60° to 80°.

The developing device according to the fifth aspect of the present invention includes: a developer container for storing a developer comprising a toner and a magnetic carrier; a developer conveying passage through which the developer is conveyed in the developer container; a developer conveying member disposed inside the developer conveying passage for agitating and conveying the developer in a predetermined direction; and, a developing roller which supports the developer in the developer conveying passage and supplies the toner contained in the developer to a photoreceptor drum, and is characterized in that the developer conveying member includes: a rotary shaft; and a multi-helically structured blade with helical blades formed on the periphery of the rotary shaft, the multi-helically structured blade includes: an inner helical blade arranged on the periphery of the rotary shaft; and, an outer helical blade having a ring-shaped form when viewed from the axial direction that inscribes the outer periphery of the inner helical blade, the inner helical blade is formed such that the radius of the helical blade varies cyclically, the outer helical blade is formed so as to have helical direction opposite to the helical direction of the inner helical blade, and, the outer helical blade inscribes the outer periphery at the minimum radius portions of the inner helical blade.

The image forming apparatus according to the sixth aspect of the present invention is an image forming apparatus for forming images with toner based on electrophotography, comprising: a photoreceptor drum for forming an electrostatic latent image on the surface thereof; a charging device for electrifying the surface of the photoreceptor drum; an exposure device for forming an electrostatic latent image on the photoreceptor drum surface; a developing device for forming a toner image by supplying toner to the electrostatic latent image on the photoreceptor drum surface; a transfer device for transferring the toner image on the photoreceptor drum surface to a recording medium; and, a fixing device for fixing the toner image to the recording medium, and is characterized in that the developing device employs any one of the developing devices having the above first to fifth aspects.

According to the developing device of the first aspect of the present invention, since the second helical pitch is smaller than the first helical pitch, the developer is moved in the axial direction of the rotary shaft, more slowly by the outer helical blade than by the inner helical blade while the developer conveying makes one revolution.

Since the radius of the helical blade is configured so as to vary cyclically, the inner helical blade makes its closest approach to the interior wall of the developer conveying passage at the maximum radius portion and produces the greatest distance from the interior wall of the developer conveying passage at the minimum radius portion. On the other hand, the ring-shaped outer helical blade comes closer to the interior wall of the developer conveying passage around the minimum radius portion. Accordingly, the inner helical blade and outer helical blade alternately approach the interior wall of the developer conveying passage, so that the flow of the developer near the interior wall of the developer conveying passage varies in speed. As a result, the developer around the interior wall of the developer conveying passage (in the space between the interior wall of the developer conveying passage and the developer conveying member) is prevented from separating from the flow of the developer that is conveyed by the developer conveying member and stagnating even if the rotational rate of the developer conveying member is increased. As result, it is possible to improve the agitation effect of the developer and hence inhibit toner concentration unevenness.

According to the developing device of the second aspect of the present invention, the developer conveyed by outer helical blade moves at half the speed of the developer that is conveyed by the inner helical blade, so that it is possible to prevent the developer from stagnating between the interior wall of the developer conveying passage and the developer conveying member and improve the agitation of the developer, hence it is possible to inhibit toner concentration unevenness.

According to the developing device of the third aspect of the present invention, it is possible to improve agitation performance (agitation effect) of the developer between the interior wall of the developer conveying passage and the developer conveying member without a noticeable reduction of developer conveying performance.

Here, if the minimum radius of the inner helical blade is less than 0.75 times of the radius of the outer helical blade, the difference between the minimum radius of the inner helical blade and the radius of the outer helical blade becomes large so that the developer conveying speed is prone to be lowered. In contrast, if the minimum radius of the inner helical blade exceeds 0.9 times of the radius of the outer helical blade, the difference between the minimum radius of the inner helical blade and the radius of the outer helical blade becomes too small so that it is difficult to fully agitate the developer between the interior wall of the developer conveying passage and the developer conveying member.

According to the developing device of the fourth aspect of the present invention, it is possible to improve agitation performance (agitation effect) of the developer between the interior wall of the developer conveying passage and the developer conveying member without a noticeable reduction of developer conveying performance.

Here, if the helical angle is less than 60°, the rotational component of the force from the outer helical blade acting on the developer becomes relatively greater, hence the friction between the developer conveyed by the outer helical blade and the interior wall of the developer conveying passage becomes large. As a result, the developer is prone to clump and stick to the interior wall of the developer conveying passage. In contrast, if the helical angle exceeds 80°, the developer readily moves in the outward (radial) directions of the developer conveying member, so that the developer conveying speed along the axial direction of the developer conveying member becomes lower. As a result, it is necessary to raise the rotational speed of the developer conveying member in order to enhance the developer conveying speed, hence the developer is prone to clump and stick to the interior wall of the developer conveying passage due to frictional heat generated between the developer and the developer conveying member.

According to the developing device of the fifth aspect of the present invention, since the outer helical blade operates so as to push back the developer with respect to the developer conveying direction of the inner helical blade, it is possible to further improve agitation of the developer in the space between the interior wall of the developer conveying passage and the developer conveying member.

According to the sixth aspect of the present invention, since the flow of the developer near the interior wall of the developer conveying passage for developer conveyance is made to vary in speed if the rotational rate of the developer conveying member in the developing device is increased, it is possible to prevent the developer from stagnating around the interior wall of the developer conveying passage and hence inhibit toner concentration unevenness. As result, it is possible to produce images free from density unevenness.

DESCRIPTION OF THE PREFERRED EMBODIMENTS

The First Embodiment

Now, the embodied modes for carrying out the present invention will be described with reference to the drawings.

Figure 1:
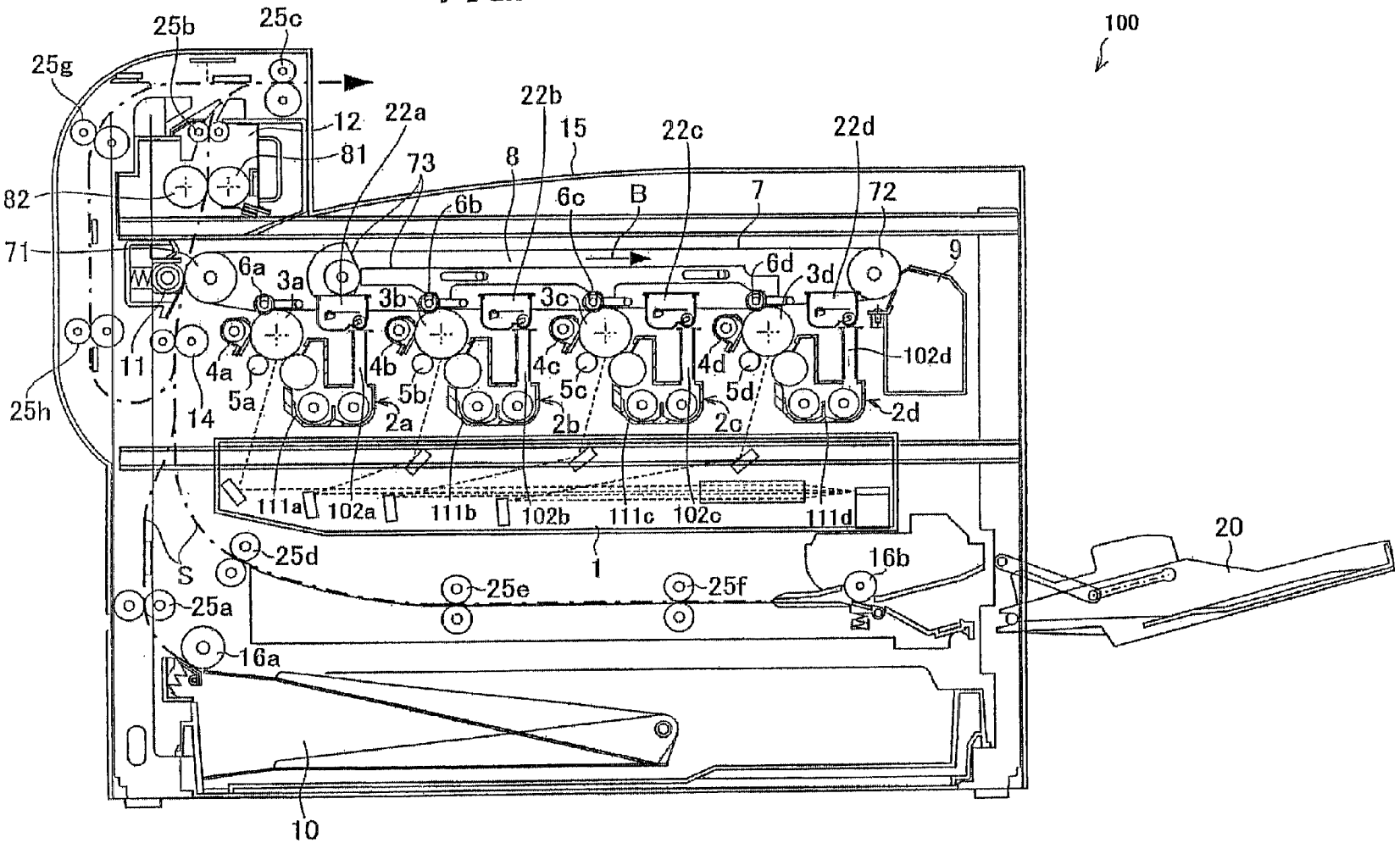
FIG. 1 is an illustrative view showing the overall configuration of an image forming apparatus including a developing device according to the first embodiment of the present invention.

FIG. 1 shows one exemplary embodiment of the present invention, and is an illustrative view showing the overall configuration of an image forming apparatus including a developing device according to the first embodiment of the present invention.

An image forming apparatus 100 of the present embodiment forms an image with toners based on electrophotography, including: as shown in FIG. 1, photoreceptor drums 3*a*, 3*b*, 3*c* and 3*d* (which may be also called "photoreceptor drums 3" when general mention is made) for forming electrostatic latent images on the surfaces thereof; chargers (charging devices) 5*a*, 5*b*, 5*c* and 5*d* (which may be also called "chargers 5" when general mention is made) for charging the surfaces of photoreceptor drums 3; an exposure unit (exposure device) 1 for forming electrostatic latent images on the photoreceptor drum 3 surfaces; developing devices 2*a*, 2*b*, 2*c* and 2*d* (which may be also called "developing devices 2" when general mention is made) for supplying toners to the electrostatic latent images on the photoreceptor drum 3 surfaces to form toner images; toner supply devices 22*a*, 22*b*, 22*c* and 22*d* (which may be also called "toner supply devices 22" when general mention is made) for supplying toners to developing devices 2; an intermediate transfer belt unit (transfer device) 8 for transferring the toner images from the photoreceptor drum 3 surfaces to a recording medium; and a fixing unit (fixing device) 12 for fixing the toner image to the recording medium.

This image forming apparatus 100 forms a multi-color or monochrome image on a predetermined sheet (recording paper, recording medium) in accordance with image data transmitted from the outside. Here, image forming apparatus 100 may also include a scanner or the like on the top thereof.

To being with, the overall configuration of image forming apparatus 100 will be described.

As shown in FIG. 1, image forming apparatus 100 separately handles image data of individual color components, i.e., black (K), cyan (C), magenta (M) and yellow (Y), and forms black, cyan, magenta and yellow images, superimpose these images of different color components to produce a full-color image.

Accordingly, image forming apparatus 100 includes, as shown in FIG. 1, four developing devices 2 (2*a*, 2*b*, 2*c* and 2*d*), four photoreceptor drums 3 (3*a*, 3*b*, 3*c* and 3*d*), four chargers 5 (5*a*, 5*b*, 5*c* and 5*d*) and four cleaner units 4 (4*a*, 4*b*, 4*c* and 4*d*) to form images of four different colors. In other words, four image forming stations (image forming portions) each including one developing device 2, one photoreceptor drum 3, one charger 5 and one cleaner unit 4 are provided.

Here, the symbols a to d are used so that 'a' represents the components for forming black images, 'b' the components for forming cyan images, 'c' the components for forming magenta images and 'd' the components for forming yellow images. Image forming apparatus 100 includes exposure unit 1, fixing unit 12, a sheet conveyor system S and a paper feed tray 10 and a paper output tray 15.

Charger 5 electrifies the photoreceptor drum 3 surface at a predetermined potential.

As charger 5, other than the contact roller-type charger shown in FIG. 1, a contact brush-type charger, a non-contact type discharging type charger and others may be used.

Exposure unit 1 is a laser scanning unit (LSU) including a laser emitter and reflection mirrors as shown in FIG. 1. Other than the laser scanning unit, arrays of light emitting elements such as EL (electroluminescence) and LED writing heads, may be also used as exposure unit 1. Exposure unit 1 illuminates the photoreceptor drums 3 that have been electrified, in accordance with input image data so as to form electrostatic latent images corresponding to the image data on the surfaces of photoreceptor drums 3.

Developing device 2 visualizes (develops) the electrostatic latent image formed on photoreceptor drum 3 with toner of K, C, M or Y. Arranged over developing devices 2 (2*a*, 2*b*, 2*c* and 2*d*) are toner transport mechanisms 102*a*, 102*b*, 102*c* and 102*d* (which may also be called "toner transport mechanisms 102 when general mention is made), toner supply devices 22 (22*a*, 22*b*, 22*c* and 22*d*) and developing vessels (developer container) 111*a*, 111*b*, 111*c* and 111*d* (which may also be called "developer vessels 111 when general mention is made).

Toner supply device 22 is arranged on the upper side of developing vessel 111 and stores unused toner (powder toner). This unused toner in toner supply device 22 is supplied to developing vessel 111 by means of toner transport mechanism 102.

Cleaner unit 4 removes and collects the toner remaining on the photoreceptor drum 3 surface after development and image transfer steps.

Arranged over photoreceptor drums 3 is an intermediate transfer belt unit 8. Intermediate transfer belt unit 8 includes intermediate transfer rollers 6*a*, 6*b*, 6*c* and 6*d* (which may also be called "intermediate transfer rollers 6 when general mention is made), an intermediate transfer belt 7, an intermediate transfer belt drive roller 71, an intermediate transfer belt driven roller 72, an intermediate transfer belt tensioning mechanism 73 and an intermediate transfer belt cleaning unit 9.

Intermediate transfer rollers 6, intermediate transfer belt drive roller 71, intermediate transfer belt driven roller 72 and intermediate transfer belt tensioning mechanism 73 support and tension intermediate transfer belt 7 to circulatively drive intermediate transfer belt 7 in the direction of an arrow B in FIG. 1.

Intermediate transfer rollers 6 are rotatably supported at intermediate transfer roller fitting portions in intermediate transfer belt tensioning mechanism 73. Applied to each intermediate transfer roller 6 is a transfer bias for transferring the toner image from photoreceptor drum 3 to intermediate transfer belt 7.

Intermediate transfer belt 7 is arranged so as to be in contact with each photoreceptor drum 3. The toner images of different color components formed on photoreceptor drums 3 are successively transferred one over another to intermediate transfer belt 7 so as to form a full-color toner image (multi-color toner image). This intermediate transfer belt 7 is formed of an endless film of about 100 to 150 μm thick, for instance.

Transfer of the toner image from photoreceptor drum 3 to intermediate transfer belt 7 is effected by intermediate transfer roller 6 which is in contact with the interior side of intermediate transfer belt 7. A high-voltage transfer bias (a high voltage of a polarity (+) opposite to the polarity (−) of the electrostatic charge on the toner) is applied to each intermediate transfer roller 6 in order to transfer the toner image.

Intermediate transfer roller 6 is composed of a shaft formed of metal (e.g., stainless steel) having a diameter of 8 to 10 mm and a conductive elastic material (e.g., EPDM, foamed urethane, etc.,) coated on the shaft surface. Use of this conductive elastic material enables intermediate transfer roller 6 to uniformly apply high voltage to intermediate transfer belt 7. Though in the present embodiment, roller-shaped elements (intermediate transfer rollers 6) are used as the transfer electrodes, brushes etc. can also be used in their place.

The electrostatic latent image formed on each of photoreceptor drums 3 is developed as described above with the toner associated with its color component into a visual toner image. These toner images are laminated on intermediate transfer belt 7, laying one image over another. The thus formed lamination of toner images is moved by rotation of intermediate transfer belt 7 to the contact position (transfer position) between the conveyed paper and intermediate transfer belt 7, and is transferred to the paper by a transfer roller 11 arranged at that position. In this case, intermediate transfer belt 7 and transfer roller 11 are pressed against each other forming a predetermined nip while a voltage for transferring the toner image to the paper is applied to transfer roller 11. This voltage is a high voltage of a polarity (+) opposite to the polarity (−) of the electrostatic charge on the toner.

In order to keep the aforementioned nip constant, either transfer roller 11 or intermediate transfer belt drive roller 71 is formed of a hard material such as metal or the like while the other is formed of a soft material such as an elastic roller or the like (elastic rubber roller, foamed resin roller etc.).

Of the toner adhering to intermediate transfer belt 7 as the belt comes in contact with photoreceptor drums 3, the toner which has not been transferred from intermediate transfer belt 7 to the paper during transfer of the toner image and remains on intermediate transfer belt 7 would cause contamination of color toners at the next operation, hence is removed and collected by an intermediate transfer belt cleaning unit 9.

Intermediate transfer belt cleaning unit 9 includes a cleaning blade (cleaning member) that comes into contact with intermediate transfer belt 7. Intermediate transfer belt 7 is supported from its interior side by intermediate transfer belt driven roller 72, at the area where this cleaning blade comes into contact with intermediate transfer belt 7.

Paper feed tray 10 is to stack sheets (e.g., recording paper) to be used for image forming and is disposed under the image forming portion and exposure unit 1. On the other hand, paper output tray 15 disposed at the top of image forming apparatus 100 stacks printed sheets with the printed face down.

Image forming apparatus 100 also includes sheet conveyor system S for guiding sheets from paper feed tray 10 and from a manual feed tray 20 to paper output tray 15 by way of the transfer portion and fixing unit 12. Here, the transfer portion is located between intermediate transfer belt drive roller 71 and transfer roller 11.

Arranged along sheet conveyor system S are pickup rollers 16 (16*a*, 16*b*), a registration roller 14, the transfer portion, fixing unit 12 and feed rollers 25 (25*a* to 25*h*) and the like.

Feed rollers 25 are a plurality of small-diametric rollers arranged along sheet conveyor system S to promote and assist sheet conveyance. Pickup roller 16*a* is a roller disposed at the end of paper feed tray 10 for picking up and supplying the paper one sheet at a time from paper feed tray 10 to sheet conveyor system S. Pickup roller 16*b* is a roller disposed at the vicinity of manual feed tray 20 for picking up and supplying the paper, one sheet at a time, from manual feed tray 20 to sheet conveyor system S. Registration roller 14 temporarily suspends the sheet being conveyed on sheet conveyor system S and delivers the sheet to the transfer portion at such timing that the front end of the sheet meets the front end of the image area on intermediate transfer belt 7.

Fixing unit 12 includes a heat roller 81, a pressing roller 82 and the like. These heat roller 81 and pressing roller 82 rotate while nipping the sheet therebetween. Heat roller 81 is controlled by a controller (not shown) so as to keep a predetermined fixing temperature. This controller controls the temperature of heat roller 81 based on the detection signal from a temperature detector (not shown).

Heat roller 81 fuses, mixes and presses the lamination of color toner images transferred on the sheet by thermally pressing the sheet with pressing roller 82 so as to thermally fix the toner onto the sheet. The sheet with a multi-color toner image (a single color toner image) fixed thereon is conveyed by plural feed rollers 25 to the inversion paper discharge path of sheet conveyor system S and discharged onto paper output tray 15 in an inverted position (with the multi-color toner image placed facedown).

Next, the operation of sheet conveyance by sheet conveyor system S will be described.

As shown in FIG. 1, image forming apparatus 100 has paper feed tray 10 that stacks sheets beforehand and manual feed tray 20 that is used when a few pages are printed out. Each tray is provided with pickup roller 16 (16*a*, 16*b*) so that these pickup rollers 16 supply the paper one sheet at a time to sheet conveyor system S.

In the case of one-sided printing, the sheet conveyed from paper feed tray 10 is conveyed by feed roller 25*a* in sheet conveyor system S to registration roller 14 and delivered to the transfer portion (the contact position between transfer roller 11 and intermediate transfer belt 7) by registration roller 14 at such timing that the front end of the sheet meets the front end of the image area including a lamination of toner images on intermediate transfer belt 7. At the transfer portion, the toner image is transferred onto the sheet. Then, this toner image is fixed onto the sheet by fixing unit 12. Thereafter, the sheet passes through feed roller 25*b* to be discharged by paper output roller 25*c* onto paper output tray 15.

Also, the sheet conveyed from manual feed tray 20 is conveyed by plural feed rollers 25 (25*f*, 25*e* and 25*d*) to registration roller 14. From this point, the sheet is conveyed and discharged to paper output tray 15 through the same path as that of the sheet fed from the aforementioned paper feed tray 10.

On the other hand, in the case of dual-sided printing, the sheet which has been printed on the first side and passed through fixing unit 12 as described above is nipped at its rear end by paper discharge roller 25*c*. Then the paper discharge roller 25*c* is rotated in reverse so that the sheet is guided to feed rollers 25*g* and 25*h*, and conveyed again through registration roller 14 so that the sheet is printed on its rear side and then discharged to paper output tray 15.

Next, the configuration of toner supply device 22 of the first embodiment will be specifically described.

Figure 2:
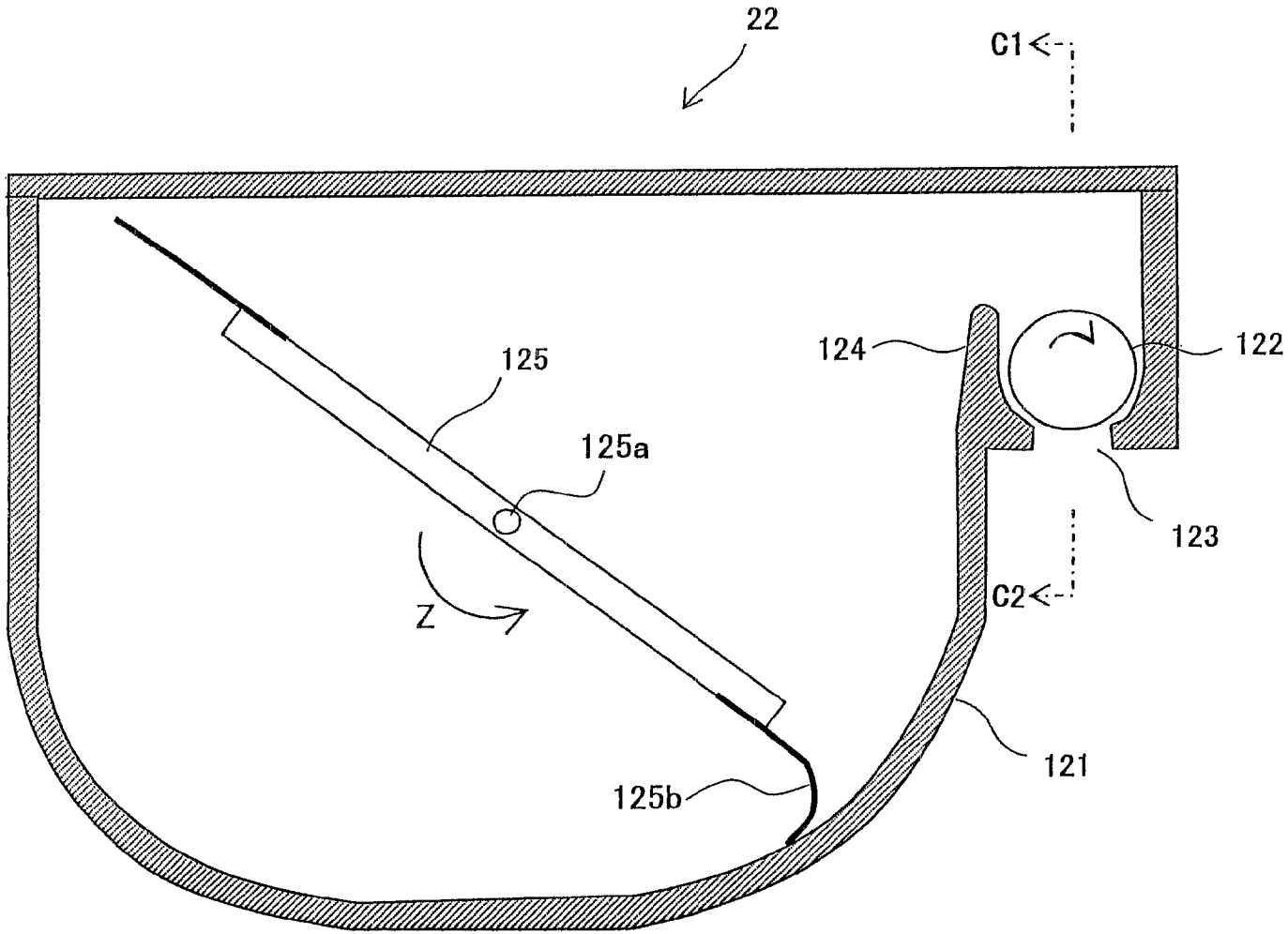
FIG. 2 is a sectional view showing the schematic configuration of a toner supply device that constitutes the image forming apparatus.
Figure 3:
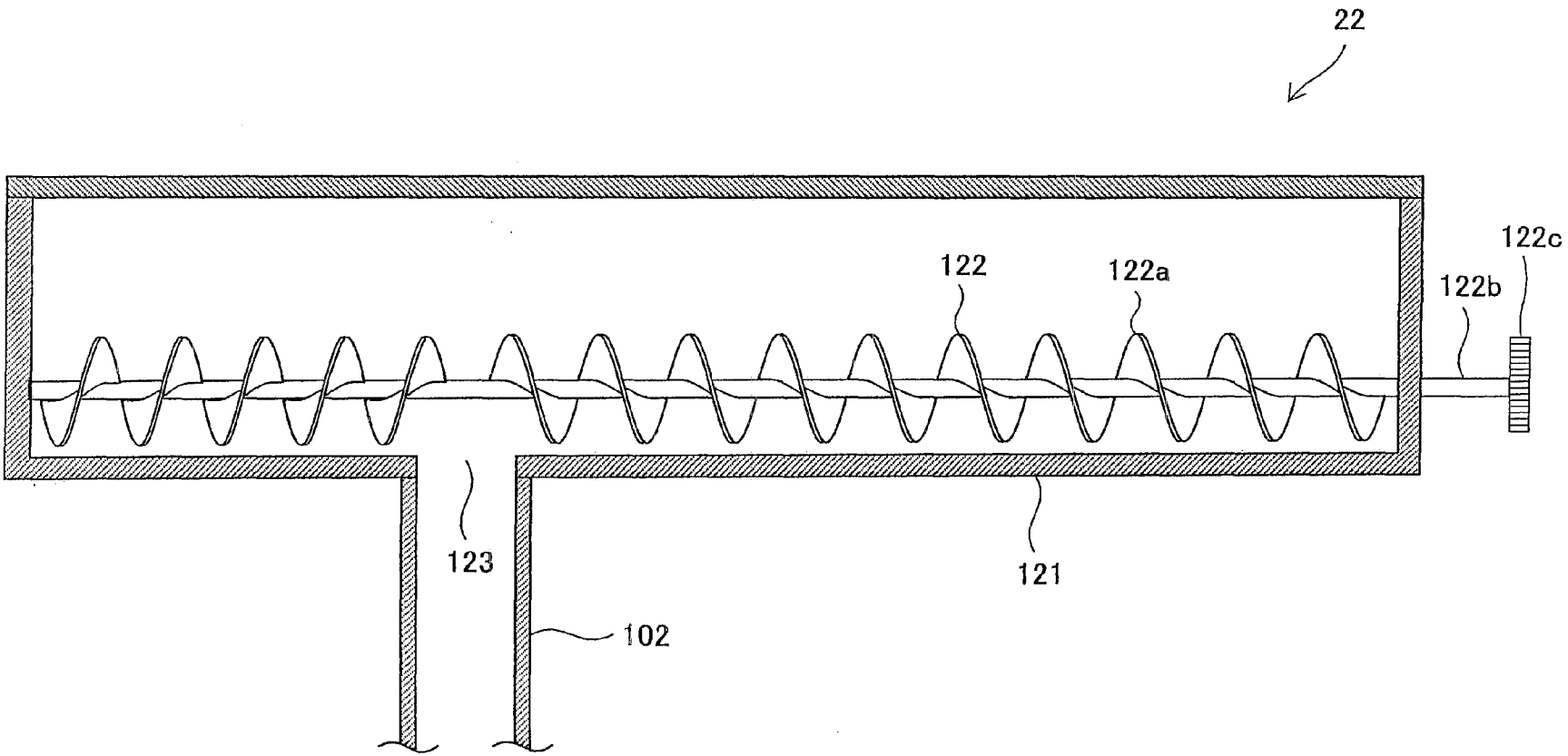
FIG. 3 is a sectional view cut along a plane C1-C2 in FIG. 2.

FIG. 2 is a sectional view showing the schematic configuration of the toner supply device that constitutes the image forming apparatus according to the first embodiment. FIG. 3 is a sectional view cut along a plane C1-C2 in FIG. 2.

As shown in FIG. 2, toner supply device 22 includes a toner storing container 121, a toner agitator 125, a toner discharger 122 and a toner discharge port 123. Toner supply device 22 is arranged on the upper side of developing vessel 111 and stores unused toner (powder toner). The toner in toner supply device 22 is supplied from toner discharge port 123 to developing vessel 111 (FIG. 1) by means of toner transport mechanism 102 (FIG. 1) as toner discharger (discharging screw) 122 is rotated.

Toner storing container 121 is a container part having a substantially semicylindrical configuration with a hollow interior, rotationally supporting toner agitator 125 and toner discharger 122 to store toner. As shown in FIG. 3, toner discharge port 123 is a substantially rectangular opening disposed under toner discharger 122 and positioned near to the center with respect to the direction of the axis (the axial direction: longitudinal direction) of toner discharger 122 so as to oppose toner transport mechanism 102.

Toner agitator 125 is a plate-like part that rotates about a rotary axis 125*a* in the direction of arrow Z as shown in FIG. 2 and draws up and conveys the toner stored inside toner storing container 121 toward toner discharger 122 whilst agitating the toner. Toner agitator 125 has a toner scooping part 125*b* extended along rotary axis 125*a* at either end. Toner scooping part 125*b* is formed of a polyethylene terephthalate (PET) sheet having flexibility and is attached to both ends parallel to rotary axis 125*a* of toner agitator 125.

Toner discharger 122 dispenses the toner in toner storing container 121 from toner discharge port 123 to developing vessel 111, and is formed of an auger screw of a toner conveyor blade 122*a* and a toner discharger rotary shaft 122*b* and a toner discharger rotating gear 122*c*, as shown in FIG. 3. Toner discharger 122 is rotationally driven by an unillustrated toner discharger drive motor. As to the helical direction of the auger screw, toner conveyor blade 122*a* is designed so that toner can be conveyed from both ends of toner discharger 122 toward toner discharge port 123 with respect to the axial direction of toner discharger rotational shaft 122*b*.

Provided between toner discharger 122 and toner agitator 125 is a toner discharger partitioning wall 124. This wall makes it possible to keep and hold the toner scooped by toner agitator 125 in an appropriate amount around toner discharger 122.

As shown in FIG. 2, toner agitator 125 rotates in the direction of arrow Z to agitate and scoop up the toner toward toner agitator 122. In this action, toner scooping parts 125*b* rotate as they are deforming and sliding over the interior wall of toner storing container 121 due to the flexibility thereof, to thereby supply the toner toward the toner discharger 122 side. Then, toner discharger 122 turns so as to lead the supplied toner to toner discharge port 123.

Next, developing device 2 will be described with reference to the drawings.

Figure 4:
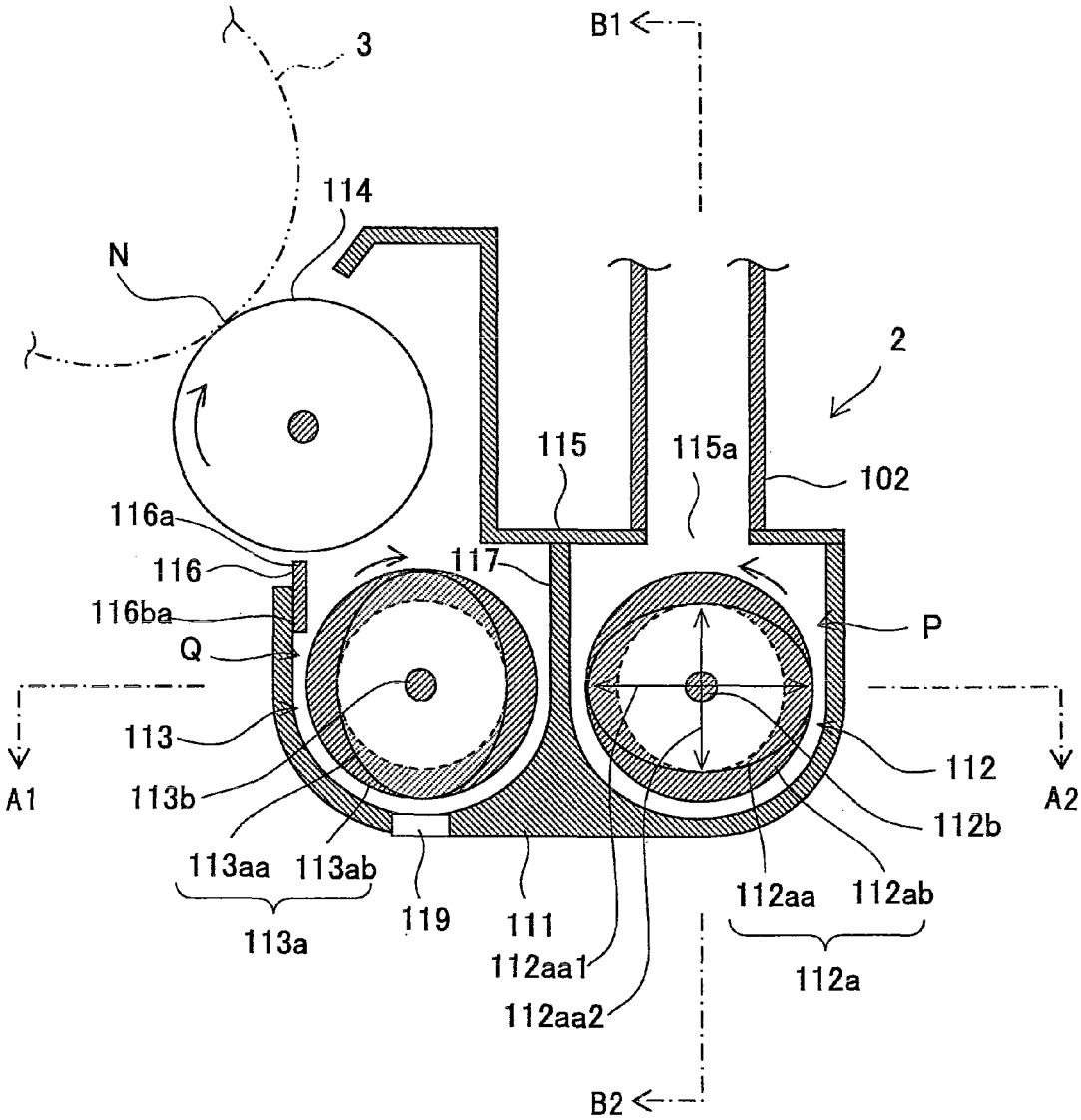
FIG. 4 is a sectional view showing the configuration of a developing device that constitutes the image forming apparatus.
Figure 5:
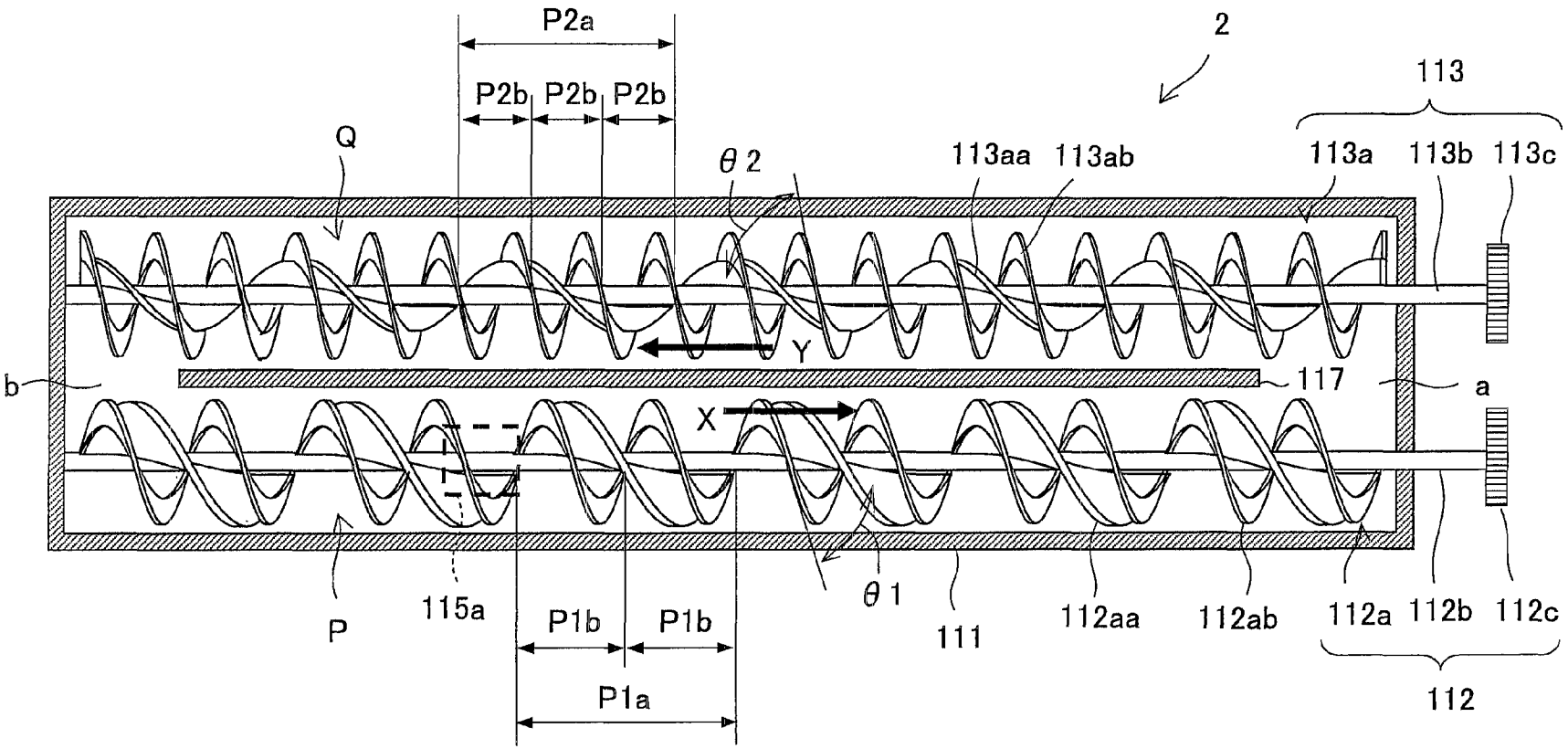
FIG. 5 is a sectional view cut along a plane A1-A2 in FIG. 4.
Figure 6:
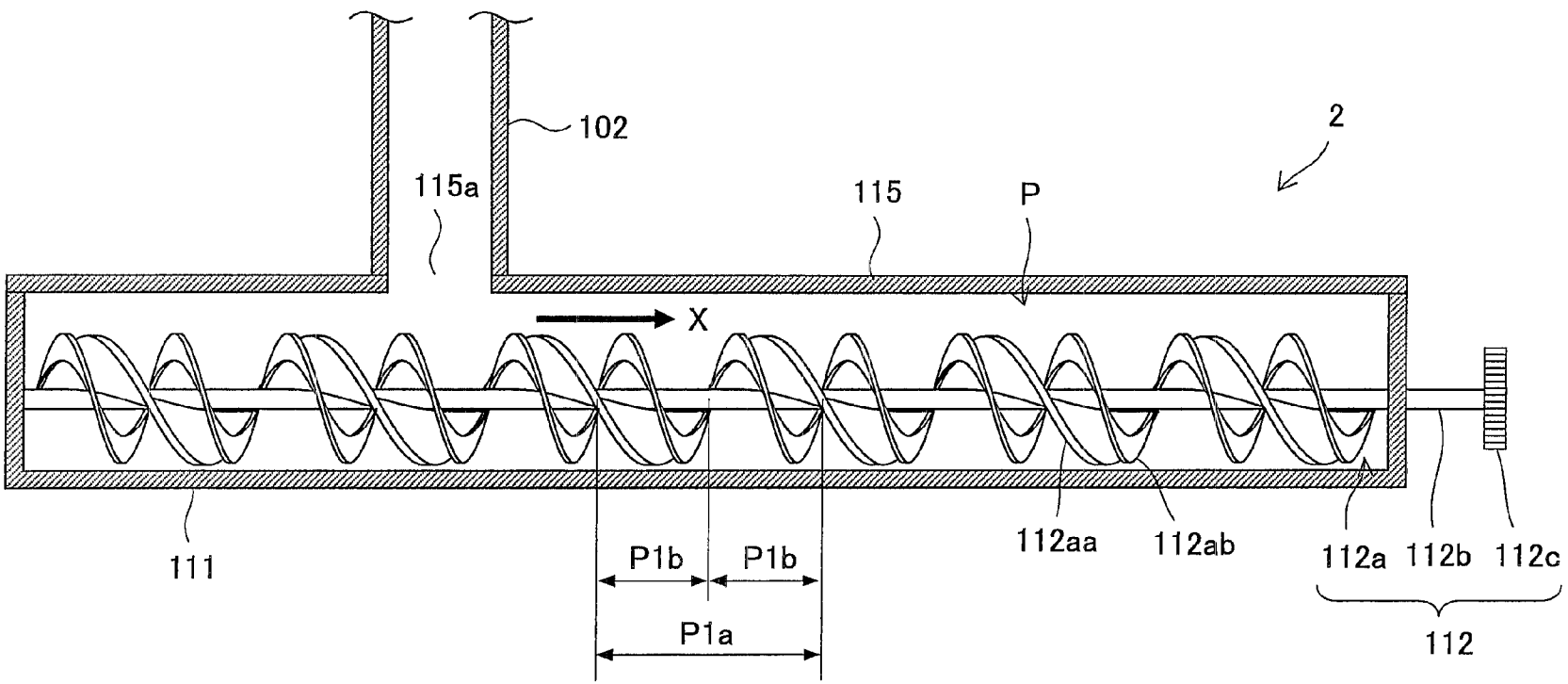
FIG. 6 is a sectional view cut along a plane B1-B2 in FIG. 4.

FIG. 4 is a sectional view showing the configuration of developing device 2 according to the first embodiment, FIG. 5 is a sectional view cut along a plane A1-A2 in FIG. 4, and FIG. 6 is a sectional view cut along a plane B1-B2 in FIG. 4.

As shown in FIG. 4, developing device 2 has a developing roller 114 arranged in developing vessel 111 so as to oppose photoreceptor drum 3 and supplies toner from developing roller 114 to the photoreceptor drum 3 surface to visualize (develop) the electrostatic latent image formed on the surface of photoreceptor drum 3.

Developing device 2, other than developing roller 114, further includes developing vessel 111, a developing vessel cover 115, a toner supply port 115*a*, a doctor blade 116, a first conveying member 112, a second conveying member 113, a partitioning plate (partitioning wall) 117 and a toner concentration detecting sensor (magnetic permeability detecting sensor) 119.

Developing vessel 111 is a container for holding a dual-component developer that contains a toner and a carrier (which will be simply referred to hereinbelow as "developer"). Developing vessel 111 includes developing roller 114, first conveying member 112, second conveying member 113 and the like. Here, the carrier of the present embodiment is a magnetic carrier presenting magnetism.

Developing roller 114 is a rotating magnet roller which is rotationally driven about its axis by an unillustrated means, draws up and carries the developer in developing vessel 111 on the surface thereof and supplies toner from the developer supported on the surface thereof to photoreceptor drum 3.

Developing roller 114 is arranged parallel to, and away from, photoreceptor drum 3, so as to oppose photoreceptor drum 3. The developer conveyed by developing roller 114 comes in contact with photoreceptor drum 3 in the area where the roller surface and the drum surface become closest. This contact area is designated as a developing nip portion N. As a developing bias is applied to developing roller 114 from an unillustrated power source that is connected to developing roller 114, the toner included in the developer on the developing roller 114 surface is supplied at developing nip portion N to the electrostatic latent image on the photoreceptor drum 3 surface.

Arranged close to the surface of developing roller 114 is a doctor blade 116. Doctor blade 116 is a rectangular plate-shaped member that is disposed vertically below developing roller 114 and supported along its longitudinal side 116*b* by developing vessel 111 so that its opposite longitudinal side 116*a* is spaced away from the developing roller 114 surface. This doctor blade 116 may be made of stainless steel, or may be formed of aluminum, synthetic resin or the like.

Toner concentration detecting sensor 119 is provided on the bottom of developing vessel 111, at a position vertically under second conveying member 113 in the approximate center with respect to the direction of the developer being conveyed, and attached with its sensor surface exposed to the interior of developing vessel 111. Toner concentration detecting sensor 119 is electrically connected to an unillustrated toner concentration controller. This toner concentration controller controls the associated components in accordance with the measurement of toner concentration detected by toner concentration detecting sensor 119 so as to supply toner from port 123 into developing vessel 111, by rotationally driving toner discharger 122.

When the toner concentration controller determines that the measurement of toner concentration from toner concentration detecting sensor 119 is lower than the set toner concentration level, the controller sends a control signal to the driver for rotationally driving toner discharger 122, so as to rotationally drive toner discharger 122.

Toner concentration detecting sensor 119 may use general-purpose detection sensors. Examples include transmitted light detecting sensors, reflected light detecting sensors, magnetic permeability detecting sensors, etc. Of these, magnetic permeability detecting sensors are preferable.

The magnetic permeability detecting sensor is connected to an unillustrated power supply. This power supply applies the drive voltage for driving the magnetic permeability detecting sensor and the control voltage for outputting the detected result of toner concentration to the controller. Application of voltage to magnetic permeability detecting sensor from the power supply is controlled by the controller. The magnetic permeability detecting sensor is a sensor that receives application of a control voltage and outputs the detected result of toner concentration as an output voltage. Since, basically, the sensor is sensitive in the middle range of the output voltage, the applied control voltage is adjusted so as to produce an output voltage around that range. Magnetic permeability detecting sensors of this kind are found on the market, examples including TS-L, TS-A and TS-K (all of these are trade names of products of TDK Corporation).

Arranged on the top of developing vessel 111 is removable developing vessel cover 115, as shown in FIG. 4. This developing vessel cover 115 is formed with toner supply port 115*a* for receiving unused toner into developing vessel 111.

Further, as shown in FIG. 1, the toner stored in toner supply device 22 is transported into developing vessel 111 through toner transport mechanism 102 and toner supply port 115*a*, and thereby supplied to developing vessel 111.

Arranged in developing vessel 111 is partitioning plate 117 between first conveying member 112 and second conveying member 113. Partitioning plate 117 is extended parallel to the axial direction (the direction in which each rotary axis is laid) of first and second conveying members 112 and 113. The interior of developing vessel 111 is divided by partitioning plate 117 into two sections, namely, a first conveying passage P with first conveying member 112 and a second conveying passage Q with second conveying member 113.

Partitioning plate 117 is arranged so that its ends, with respect to the axial direction of first and second conveying members 112 and 113, are spaced from respective interior wall surfaces of developing vessel 111. Hereby, developing vessel 111 has communicating paths that communicate between first conveying passage P and second conveying passage Q at around both axial ends of first and second conveying members 112 and 113. In the following description, as shown in FIG. 5, the communicating path formed on the downstream side with respect to the direction of arrow X is named first communicating path a and the communicating path formed on the downstream side with respect to the direction of arrow Y is named second communicating path b.

First conveying member 112 and second conveying member 113 are arranged so that their axes are parallel to each other with their peripheral sides opposing each other across partitioning plate 117, and rotated in opposite directions. That is, as shown in FIG. 5, first conveying member 112 conveys the developer in the direction of arrow X while second conveying member 113 conveys the developer in the direction of arrow Y, which is the opposite to the direction of arrow X.

As shown in FIG. 5, toner supply port 115*a* is formed within first conveying passage P at a position downstream of second communicating path b with respect to the direction of arrow X. That is, toner is supplied into first conveying passage P at a position downstream of second communicating path b.

In developing vessel 111, first conveying member 112 and second conveying member 113 are rotationally driven by a drive means (not shown) such as a motor etc., to convey the developer.

More specifically, in first conveying passage P, the developer is agitated and conveyed in the direction of arrow X by first conveying member 112 to reach first communicating path a. The developer reaching first communicating path a is conveyed through first communicating path a to second conveying passage Q.

On the other hand, in second conveying passage Q, the developer is agitated and conveyed in the direction of arrow Y by second conveying member 113 to reach second communicating path b. Then, the developer reaching second communicating path b is conveyed through second communicating path b to first conveying passage P.

That is, first conveying member 112 and second conveying member 113 agitate the developer while conveying it in opposite directions.

In this way, the developer is circulatively moving in developing vessel 111 along first conveying passage P, first communicating path a, second conveying passage Q and second communicating path b, in this mentioning order. In this arrangement, the developer is carried and drawn up by the surface of rotating developing roller 114 while being conveyed in second conveying passage Q, and the toner in the drawn up developer is continuously consumed as moving toward photoreceptor drum 3.

In order to compensate for this consumption of toner, unused toner is supplied from toner supply port 115*a* into first conveying passage P. The supplied toner is agitated and mixed with the previously existing developer in the first conveying passage P.

Now, first conveying member 112 and second conveying member 113 will be described in detail with reference to the drawings.

As shown in FIG. 5, first conveying member 112 is composed of an auger screw formed of a first conveying blade 112*a* that is made up of a first inner helical blade 112*aa* and a first outer helical blade 112*ab* defining a ring-shaped form and a first rotary shaft 112*b*, and a first conveying gear 112*c*. First conveying member 112 is rotationally driven by a drive means (not shown) such as a motor etc., to agitate and convey the developer.

First inner helical blade 112*aa* is a sheet-like part projectively attached on the periphery of first rotary shaft 112*b* and arranged helically about the longitudinal axis of first rotary shaft 112*b*.

As shown in FIG. 4, first inner helical blade 112*aa* has an elliptic configuration when the helical blade is viewed from its axial direction (the direction perpendicular to the direction of the axis of first rotary shaft 112*b* (the axial direction)), or has such a structure that the radius of the helical blade varies on a rotational angular cycle of 180 degrees.

Here, the radius of the helical blade indicates the distance from the center of first rotary shaft 112*b* to the outer periphery of the helical blade that is farthest from the center of first rotary shaft 112*b*. Further, the rotational angular cycle indicates the angle (central angle) formed between one radius and another radius.

As shown in FIG. 4, first outer helical blade 112*ab* is a helical ring-shaped blade defining a donut form when the helical blade is viewed from its axial direction (the direction perpendicular to the axial direction of the axis of first rotary shaft 112*b*), and is arranged so that its interior diameter edge of the helical ring configuration is put in contact with the minimum radius portions of first inner helical blade 112*aa*. Thereby, first outer helical blade 112*ab* is supported by first inner helical blade 112*aa*.

Further, as shown in FIG. 5, first outer helical blade 112*ab* is formed so as to have a helical pitch (second helical pitch P1*b*) that is one half of the helical pitch (first helical pitch P1*a*) of first inner helical blade 112*aa*. Here, the helical pitch is the interval along the first rotary shaft 112*b* between the adjacent points of an identical helical blade having the same phase.

As shown in FIG. 4, first inner helical blade 112*aa* and first outer helical blade 112*ab* are formed so that the maximum radius of first inner helical blade 112*aa* has the same dimension as the radius of first outer helical blade 112*ab*.

Further, the minimum radius of first inner helical blade 112*aa* is preferably specified to fall within the range of 0.75 times to 0.9 times of the radius of first outer helical blade 112*ab*. In the present embodiment, the minimum radius of first inner helical blade 112*aa* is formed to be 0.8 times of the radius of first outer helical blade 112*ab*.

Here, if the minimum radius of first inner helical blade 112*aa* is less than 0.75 times of the radius of first outer helical blade 112*ab*, the difference between the minimum radius of first inner helical blade 112*aa* and the radius of first outer helical blade 112*ab* becomes large so that the developer conveying speed is prone to be lowered. In contrast, if the minimum radius of first inner helical blade 112*aa* exceeds 0.9 times of the radius of first outer helical blade 112*ab*, the difference between the minimum radius of first inner helical blade 112*aa* and the radius of first outer helical blade 112*ab* becomes too small so that it is difficult to fully agitate the developer between the interior wall of first conveying passage P and first conveying member 112.

Additionally, as shown in FIG. 5 the helical angle θ1 formed between first outer helical blade 112*ab* and the axis of first rotary shaft 112*b* in the first conveying member 112 is preferably specified to fall within the range of 60° to 80°. In the present embodiment, the helical angle θ1 is set to be 70°.

Here, if the helical angle θ1 is less than 60°, the rotational component of the force from first outer helical blade 112*ab* acting on the developer becomes relatively greater, hence the friction between the developer conveyed by first outer helical blade 112*ab* and the interior wall of first conveying passage P becomes large. As a result, the developer is prone to clump and stick to the interior wall of first conveying passage P. In contrast, if the helical angle θ1 exceeds 80°, the developer readily moves in the outward (radial) directions of first conveying member 112, so that the developer conveying speed along the axial direction of first conveying member 112 becomes lower. As a result, it is necessary to raise the rotational speed of first conveying member 112 in order to enhance the developer conveying speed, hence the developer is prone to clump and stick to the interior wall of first conveying passage P due to frictional heat generated between the developer and first conveying member 112.

As shown in FIG. 5, second conveying member 113 is composed of an auger screw formed of a second conveying blade 113*a* that is made up of second inner helical blade 113*aa* and a second outer helical blade 113*ab* defining a ring-shaped form and a second rotary shaft 113*b*, and a second conveying gear 113*c*. Second conveying member 113 is rotationally driven by a drive means (not shown) such as a motor etc., to agitate and convey the developer.

As shown in FIG. 4, second inner helical blade 113*aa* has an elliptic configuration when the helical blade is viewed from its axial direction (the direction perpendicular to the axial direction of second rotary shaft 113*b*), or has such a structure that the radius of the helical blade varies in a rotational angular cycle of 180 degrees.

Here, the radius of the helical blade indicates the distance from the center of second rotary shaft 113*b* to the outer periphery of the helical blade that is farthest from the center of second rotary shaft 113*b*. Further, the rotational angular cycle indicates the angle (central angle) formed between one radius and another radius.

As shown in FIG. 4, second outer helical blade 113*ab* is a helical ring-shaped blade defining a donut form when the helical blade is viewed from its axial direction (the direction perpendicular to the axial direction of the axis of second rotary shaft 113*b*), and is arranged so that its interior diameter edge of the helical ring configuration is put in contact with the minimum radius portions of second inner helical blade 113*aa*. In this way, second outer helical blade 113*ab* is supported by second inner helical blade 113*aa*.

Further, as shown in FIG. 5, second outer helical blade 113*ab* is formed so as to have a helical pitch (which will be referred to hereinbelow as fourth helical pitch P2*b*) that is one third of the helical pitch (which will be referred to hereinbelow as third helical pitch P2*a*) of second inner helical blade 113*aa*.

As shown in FIG. 4, second inner helical blade 113*aa* and second outer helical blade 113*ab* are formed so that the maximum radius of second inner helical blade 113*aa* has the same dimension as the radius of second outer helical blade 113*ab*.

Further, the minimum radius of second inner helical blade 113*aa* is preferably specified to fall within the range of 0.75 times to 0.9 times of the radius of second outer helical blade 113*ab*. In the present embodiment, the minimum radius of second inner helical blade 113*aa* is formed to be 0.8 times of the radius of second outer helical blade 113*ab*.

Here, if the minimum radius of second inner helical blade 113*aa* is less than 0.75 times of the radius of second outer helical blade 113*ab*, the difference between the minimum radius of second inner helical blade 113*aa* and the radius of second outer helical blade 113*ab* becomes large so that the developer conveying speed is prone to be lowered. In contrast, if the minimum radius of second inner helical blade 113*aa* exceeds 0.9 times of the radius of second outer helical blade 113*ab*, the difference between the minimum radius of second inner helical blade 113*aa* and the radius of second outer helical blade 113*ab* becomes too small so that it is difficult to fully agitate the developer between the interior wall of second conveying passage Q and second conveying member 113.

Additionally, as shown in FIG. 5 the helical angle θ2 formed between second outer helical blade 113*ab* and the axis of second rotary shaft 113*b* in second conveying member 113 is preferably specified to fall within the range of 60° to 80°. In the present embodiment, the helical angle θ2 is set to be 70°.

Here, if the helical angle θ2 is less than 60°, the rotational component of the force from second outer helical blade 113*ab* acting on the developer becomes relatively greater, hence the friction between the developer conveyed by second outer helical blade 113*ab* and the interior wall of second conveying passage Q becomes large. As a result, the developer is prone to clump and stick to the interior wall of second conveying passage Q. In contrast, if the helical angle θ2 exceeds 80°, the developer readily moves in the outward (radial) directions of second conveying member 113, so that the developer conveying speed along the axial direction of second conveying member 113 becomes lower. As a result, it is necessary to raise the rotational speed of second conveying member 113 in order to enhance the developer conveying speed, hence the developer is prone to clump and stick to the interior wall of second conveying passage Q due to frictional heat generated between the developer and second conveying member 113.

Next, the operation of developing device 2 at the time of conveying the developer will be described with reference to the drawings.

According to developing device 2 of the first embodiment, as shown in FIG. 5 the developer in developing vessel 111 is conveyed by first and second conveying members 112 and 113, in the direction of arrow X in first conveying passage P and in the direction of arrow Y in the second conveying passage Q.

The condition of the developer being agitated and conveyed by first and second conveying members 112 and 113 will be described taking the example of first conveying member 112.

As shown in FIG. 5, the developer inside first conveying passage P is agitated and conveyed by rotation of first conveying member 112. The developer, as receiving force oriented in the direction of arrow X from first inner helical blade 112*aa* and first outer helical blade 112*ab*, is conveyed in the X-direction in the drawing.

Since, as shown in FIG. 4, first inner helical blade 112*aa* has an elliptic configuration whose radius varies on a rotational angular cycle of 180 degrees when the helical blade is viewed from its axial direction (the direction perpendicular to the axial direction of first rotary shaft 112*b*), first inner helical blade 112*aa* makes its closest approach to the interior wall of first conveying passage P at the maximum radius portion (maximum outside diametric portion) 112*aa*1 and produces the greatest distance from the interior wall of first conveying passage P at the minimum radius portion (minimum outside diametric portion) 112*aa*2.

First outer helical blade 112*ab* comes closer to the interior wall of first conveying passage P around the minimum radius portion 112*aa*2 of first inner helical blade 112*aa*. Accordingly, first inner helical blade 112*aa* and first outer helical blade 112*ab* alternately approach the interior wall of first conveying passage P, so that the flow of the developer near the interior wall of first conveying passage P varies in speed.

As a result, the developer around the interior wall of first conveying passage P (in the space between the interior wall of first conveying passage P and first conveying member 112) is agitated by first inner helical blade 112*aa* and first outer helical blade 112*ab*, hence it is possible to prevent stagnation of the developer due to separation of the developer around the interior wall of first conveying passage P from the flow of the developer being conveyed by first conveying member 112 even if the rotational rate of first conveying member 112 is increased. Thereby, it is possible to inhibit toner concentration unevenness.

Further, since first outer helical blade 112*ab* is configured so that second helical pitch P1*b* is one half of first helical pitch P1*a* of first inner helical blade 112*aa* as shown in FIG. 5, the developer conveyed by first outer helical blade 112*ab* moves at half the speed of the developer that is conveyed by first inner helical blade 112*aa*. In this way, the flow of the developer near the interior wall of first conveying passage P varies in speed.

As a result, the developer around the interior wall of first conveying passage P (in the space between the interior wall of first conveying passage P and first conveying member 112) is agitated by first inner helical blade 112*aa* and first outer helical blade 112*ab*, hence it is possible to prevent stagnation of the developer from occurring between the interior wall of first conveying passage P and first conveying member 112. It is therefore possible to inhibit toner concentration unevenness.

Moreover, since first inner helical blade 112*aa* is configured such that the maximum radius has the same dimension as the radius of first outer helical blade 112*ab* and the minimum radius is formed to be 0.8 times of the radius of first outer helical blade 112*ab* as shown in FIG. 4, the flow of the developer near the interior wall of first conveying passage P varies in speed as first conveying member 112 rotates.

As a result, agitation of the developer around the interior wall of first conveying passage P can be improved, so that it is possible to prevent stagnation of the developer from occurring between the interior wall of first conveying passage P and first conveying member 112 and hence inhibit toner concentration unevenness. Further, since first inner helical blade 112*aa* is configured so that its minimum radius is not markedly different from the radius of first outer helical blade 112*ab*, there is no risk of excessively reducing the performance of developer conveyance.

Though the above description was made on agitation and conveyance of the developer by first conveying member 112, the agitation performance of the developer in second conveying passage Q by second conveying member 113 can be improved in the same manner as first conveying member 112 does because second conveying member 113 has a configuration similar to first conveying member 112.

In particular, second outer helical blade 113*ab* that constitutes second conveying member 113 is configured so as to have a fourth helical pitch P2*b* that is one third of the third helical pitch P2*a* of second inner helical blade 113*aa*, the developer conveyed by second outer helical blade 113*ab* moves at one third of the speed of the developer that is conveyed by second inner helical blade 113*aa*. In this way, the flow of the developer near the interior wall of second conveying passage Q varies in speed.

As a result, the developer around the interior wall of second conveying passage Q (in the space between the interior wall of second conveying passage Q and second conveying member 113) is agitated by second inner helical blade 113*aa* and second outer helical blade 113*ab*, hence it is possible to prevent stagnation of the developer from occurring between the interior wall of second conveying passage Q and second conveying member 113. It is therefore possible to inhibit toner concentration unevenness.

As described above, according to the first embodiment, developing device 2 including first conveying blade 112*a* having a double helical structure made of first inner helical blade 112*aa* and first outer helical blade 112*ab* as first conveying member 112 and second conveying blade 113*a* having a double helical structure made of second inner helical blade 113*aa* and second outer helical blade 113*ab* as second conveying member 113, makes it possible to improve agitation performance of the developer in first conveying passage P and second conveying passage Q.

Therefore, according to image forming apparatus 100 of the present embodiment, improvement of the agitation performance of the developer by developing device 2 can provide stable image density without causing toner concentration unevenness.

In the first embodiment, first conveying blade 112*a* is configured so that second helical pitch P1*b* of first outer helical blade 112*ab* is set to be one half of first helical pitch P1*a* of first inner helical blade 112*aa* while second conveying blade 113*a* is configured so that fourth helical pitch P2*b* of second outer helical blade 113*ab* is set to be one third of third helical pitch P2*a* of second inner helical blade 113*aa*. However, the present invention should not be limited to this configuration.

Figure 7:
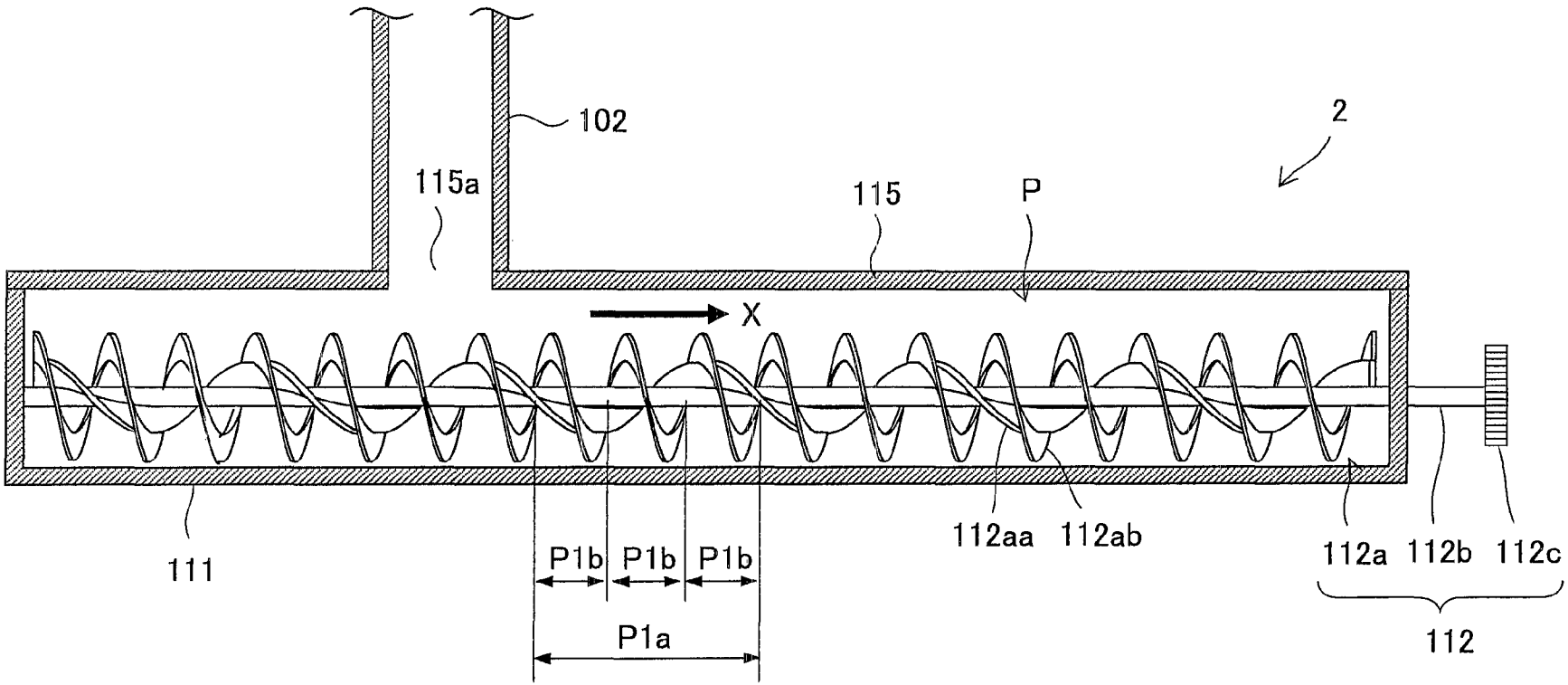
FIG. 7 is an illustrative view showing a variational configuration of the developing device.

For example, as shown in FIG. 7, first conveying blade 112*a* may be given in the same configuration as second conveying blade 113*a* so that second helical pitch P1*b* of first outer helical blade 112*ab* is set to be one third of first helical pitch P1*a* of first inner helical blade 112*aa*.

Alternatively, second conveying blade 113*a* may be given in the same configuration as first conveying blade 112*a* so that fourth helical pitch P2*b* of second outer helical blade 113*ab* is set to be one half of third helical pitch P2*a* of second inner helical blade 113*aa*.

The Second Embodiment

Next, the second embodiment for carrying out the present invention will be described with reference to the drawings.

Figure 8:
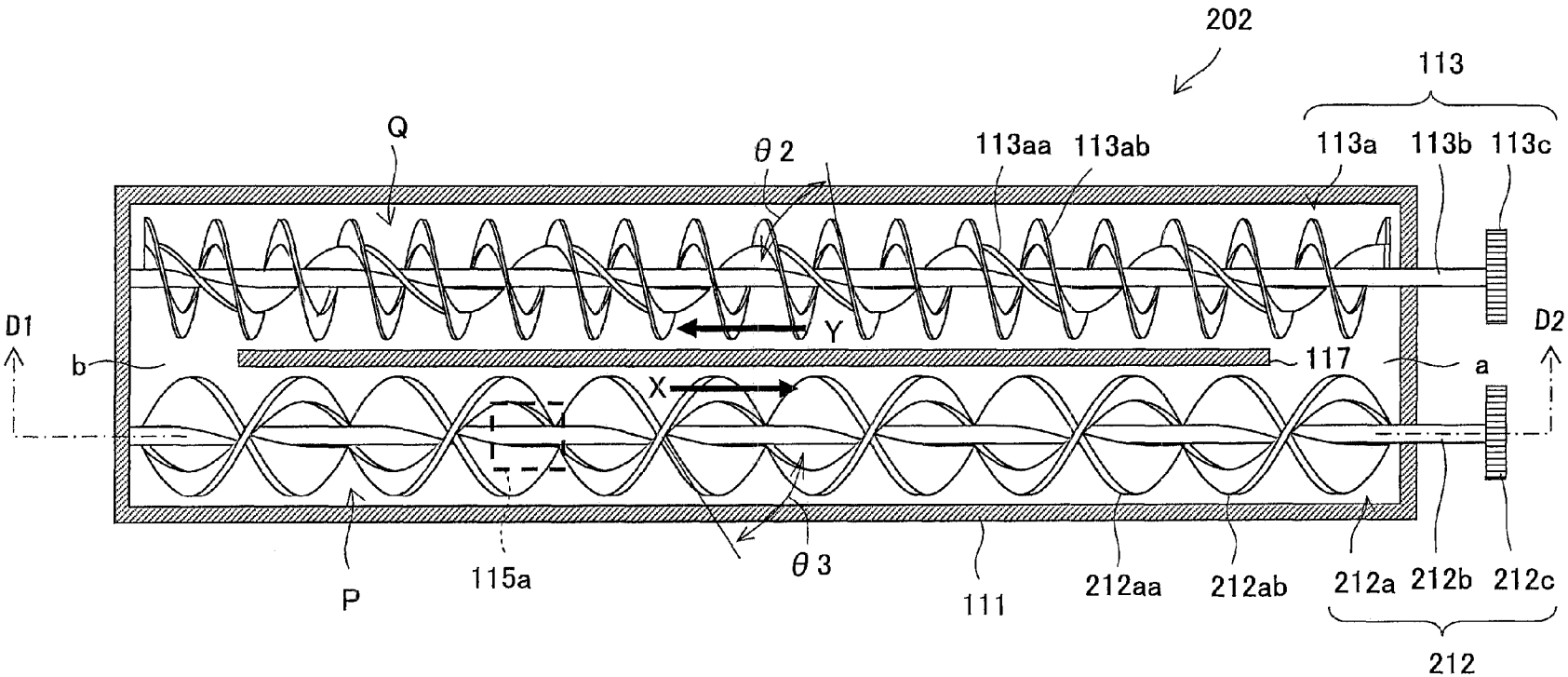
FIG. 8 is a sectional view showing the configuration of a developing device according to the second embodiment of the present invention; and, FIG. 9 is a sectional view cut along a plane D1-D2 in FIG. 8, showing a first conveying member as a part of the developing device.
Figure 9:
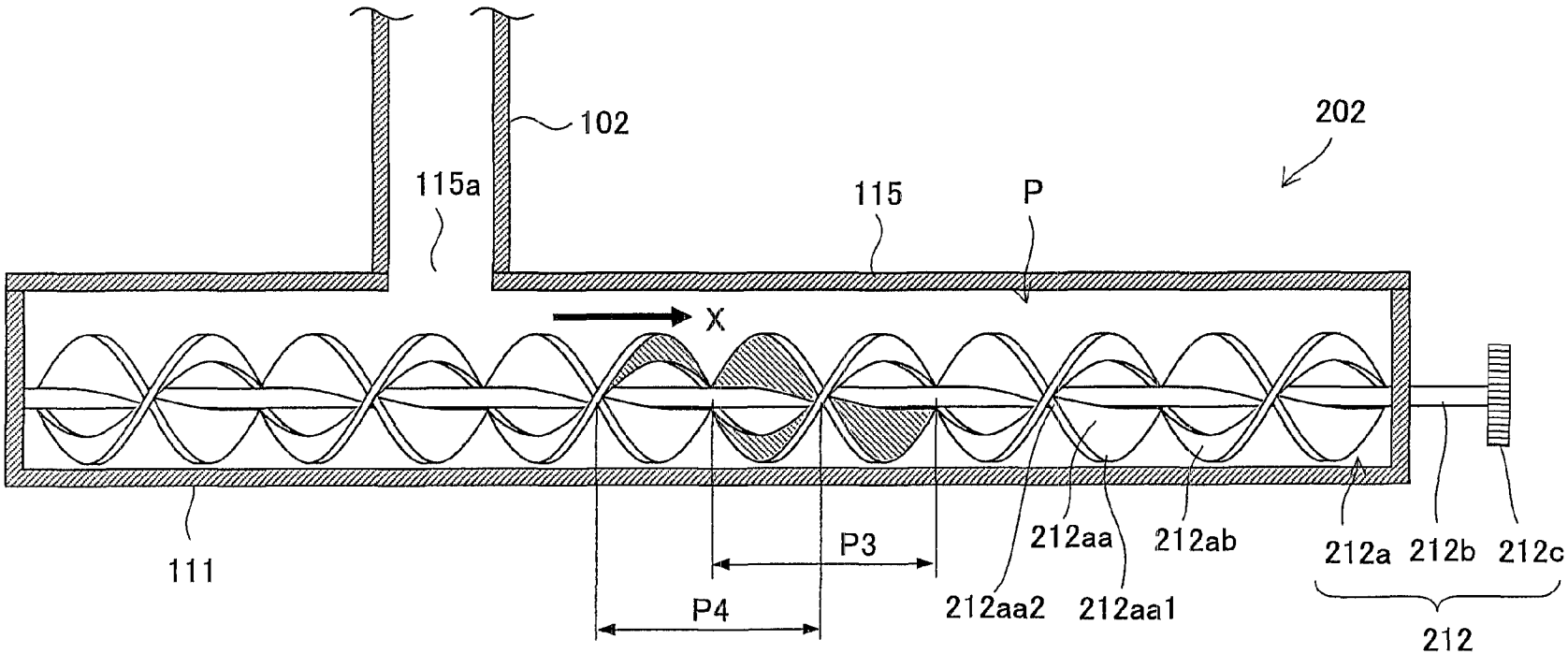

FIG. 8 is a sectional view showing the configuration of a developing device according to the second embodiment of the present invention. FIG. 9 is a sectional view cut along a plane D1-D2 in FIG. 8, showing a first conveying member as a part of the developing device.

Since the developing device of the second embodiment has the same configuration as that of developing device 2 of the first embodiment except in that the outer helical blade as a part of the first conveying member has opposite helical direction (that conveys the developer in the opposite direction) to that of the inner helical blade, the components having the same configurations will be allotted with the same reference numerals and description on those is omitted.

As shown in FIG. 8, a developing device 202 according to the second embodiment is constructed such that a developing vessel 111 is divided into a first conveying passage P and a second conveying passage Q by a partitioning plate 117, first convening passage P and second conveying passage Q including a first conveying member 212 and a second conveying member 113, respectively.

As shown in FIGS. 8 and 9, first conveying member 212 is composed of an auger screw formed of a first conveying blade 212*a* that is made up of a first inner helical blade 212*aa* and a first outer helical blade 212*ab* defining a ring-shaped form and a first rotary shaft 212*b*, and a first conveying gear 212*c*. First conveying member 212 is rotationally driven by a drive means (not shown) such as a motor etc., to agitate and convey the developer.

Similarly to first inner helical blade 112*aa* of the first embodiment shown in FIG. 4, first inner helical blade 212*aa* has an elliptic configuration when the helical blade is viewed from its axial direction, or has such a structure that the radius of the helical blade varies on a rotational angular cycle of 180 degrees.

Here, the radius of the helical blade indicates the distance from the center of first rotary shaft 212*b* to the outer periphery of the helical blade that is farthest from the center of first rotary shaft 212*b*. Further, the rotational angular cycle indicates the angle (central angle) formed between one radius and another radius.

Similarly to first outer helical blade 112*ab* of the first embodiment shown in FIG. 4, first outer helical blade 212*ab* is a helical ring-shaped blade defining a donut form when the helical blade is viewed from its axial direction, and is arranged so that its interior diameter edge of the helical ring configuration is put in contact with the minimum radius portions of first inner helical blade 212*aa*. Thereby, first outer helical blade 212*ab* is supported by first inner helical blade 212*aa*.

The helical direction of first outer helical blade 212*ab* is set to be opposite to that of first inner helical blade 212*aa* while the helical pitch P3 of first inner helical blade 212*aa* is set equal to the helical pitch P4 of first outer helical blade 212*ab*.

First inner helical blade 212*aa* and first outer helical blade 212*ab* are formed so that the maximum radius of first inner helical blade 212*aa* has the same dimension as the radius of first outer helical blade 212*ab*.

Further, the minimum radius of first inner helical blade 212*aa* is preferably specified to fall within the range of 0.75 times to 0.9 times the radius of first outer helical blade 212*ab*. In the present embodiment, the minimum radius of first inner helical blade 212*aa* is formed to be 0.8 times the radius of first outer helical blade 212*ab*.

The helical angle θ3 (FIG. 8) formed between first outer helical blade 212*ab* and the axis of first rotary shaft 212*b* is preferably specified to fall within the range of 60° to 80°. In the present embodiment, the helical angle θ3 is set to be 70°.

Next, the characteristic operation of developing device 202 at the time of conveying the developer will be described with reference to the drawings.

According to developing device 202 of the second embodiment, as shown in FIG. 8 the developer in developing vessel 111 is conveyed by first and second conveying members 212 and 113, in the direction of arrow X in first conveying passage P and in the direction of arrow Y in the second conveying passage Q.

The condition of the developer being agitated and conveyed by first conveying member 212 will be described.

As shown in FIG. 9, the developer inside first conveying passage P is agitated and conveyed by rotation of first conveying member 212. The developer, as receiving force oriented in the direction of arrow X from first inner helical blade 212*aa* and first outer helical blade 212*ab*, is conveyed rightwards in the drawing.

Since first inner helical blade 212*aa* has an elliptic configuration whose radius varies on a rotational angular cycle of 180 degrees when the helical blade is viewed from its axial direction (the direction perpendicular to the axial direction of first rotary shaft 212*b*), the first inner helical blade 212*aa* makes its closest approach to the interior wall of first conveying passage P at the maximum radius portion 212*aa*1 and produces the greatest distance from the interior wall of first conveying passage P at the minimum radius portion (minimum outside diametric portion) 212*aa*2.

As first conveying member 212 rotates, the developer in first conveying passage P is conveyed by first inner helical blade 212*aa* in the direction of arrow X and is also conveyed by first outer helical blade 212*ab* in the direction opposites to the direction of arrow X.

Since first outer helical blade 212*ab* is located close to the interior wall of first conveying passage P around the minimum radius portion 212*aa*2 of first inner helical blade 212*aa*, the developer around the interior wall of first conveying passage P is conveyed in the opposite direction to the direction of arrow X.

As a result, the developer around the interior wall of first conveying passage P (in the space between the interior wall of first conveying passage P and first conveying member 212) is conveyed back and forth along the axial direction of first conveying member 212 by first inner helical blade 212*aa* and first outer helical blade 212*ab*, so that the agitation effect is further improved.

According to the second embodiment configured as above, first outer helical blade 212*ab* is formed with opposite direction to that of first inner helical blade 212*aa* so as to convey the developer in the opposite direction with respect to the developer conveying direction of first inner helical blade 212*aa*. As a result, it is possible to further improve agitation of the developer in the space between the interior wall of first conveying passage P and first conveying member 212. Thereby, it is possible to inhibit toner conventional unevenness.

Here, it goes without saying that second conveying member 113 may be configured in the same manner as first conveying member 212.

Though the above embodiments were described taking examples in which developing devices 2 and 202 of the present invention are applied to image forming apparatus 100 shown in FIG. 1, as long as it is an image forming apparatus using a developing device in which the developer in developing vessel 111 is conveyed while being agitated by a developer conveying member, the invention can be developed to any other image forming apparatus and the like, not limited to the image forming apparatus and copier described above.

Having described heretofore, the present invention is not limited to the above embodiments, various changes can be made within the scope of the appended claims. That is, any embodied mode obtained by combination of technical means modified as appropriate without departing from the spirit and scope of the present invention should be included in the technical art of the present invention.

What is claimed is:

1. A developing device comprising:

a developer container for storing a developer comprising a toner and a magnetic carrier;

a developer conveying passage through which the developer is conveyed in the developer container;

a developer conveying member disposed inside the developer conveying passage for agitating and conveying the developer in a predetermined direction; and, a developing roller which supports the developer in the developer conveying passage and supplies the toner contained in the developer to a photoreceptor drum, characterized in that the developer conveying member includes: a rotary shaft; and a multi-helically structured blade with helical blades formed on the periphery of the rotary shaft, the multi-helically structured blade includes:

an inner helical blade arranged on the periphery of the rotary shaft; and, an outer helical blade having a ring-shaped form when viewed from the axial direction that inscribes the outer periphery of the inner helical blade, the inner helical blade is formed such that the radius of the helical blade varies cyclically, the second helical pitch of the outer helical blade is smaller than the first helical pitch of the inner helical blade, and, the outer helical blade inscribes the outer periphery at the minimum radius portions of the inner helical blade.

2. The developing device according to claim 1, wherein the second helical pitch is one half of the first helical pitch.

3. The developing device according to claim 1, wherein the maximum radius of the inner helical blade is equal to the radius of the outer helical blade, and the minimum radius of the inner helical blade is within the range of 0.75 times to 0.9 times the radius of the outer helical blade.

4. The developing device according to claim 1, wherein the helical angle formed between the axis of the rotary shaft and the outer helical blade falls within the range of 60° to 80°.

5. A developing device comprising:

a developer container for storing a developer comprising a toner and a magnetic carrier;

a developer conveying passage through which the developer is conveyed in the developer container;

a developer conveying member disposed inside the developer conveying passage for agitating and conveying the developer in a predetermined direction; and, a developing roller which supports the developer in the developer conveying passage and supplies the toner contained in the developer to a photoreceptor drum, characterized in that the developer conveying member includes: a rotary shaft; and a multi-helically structured blade with helical blades formed on the periphery of the rotary shaft, the multi-helically structured blade includes:

an inner helical blade arranged on the periphery of the rotary shaft; and, an outer helical blade having a ring-shaped form when viewed from the axial direction that inscribes the outer periphery of the inner helical blade, the inner helical blade is formed such that the radius of the helical blade varies cyclically, the outer helical blade is formed so as to have helical direction opposite to the helical direction of the inner helical blade, and, the outer helical blade inscribes the outer periphery at the minimum radius portions of the inner helical blade.

6. An image forming apparatus for forming images with toner based on electrophotography, comprising:

a photoreceptor drum for forming an electrostatic latent image on the surface thereof;

a charging device for electrifying the surface of the photoreceptor drum;

an exposure device for forming an electrostatic latent image on the photoreceptor drum surface;

a developing device for forming a toner image by supplying toner to the electrostatic latent image on the photoreceptor drum surface;

a transfer device for transferring the toner image on the photoreceptor drum surface to a recording medium; and, a fixing device for fixing the toner image to the recording medium, characterized in that the developing device employs the developing device defined in claim 1.

7. An image forming apparatus for forming images with toner based on electrophotography, comprising:

a photoreceptor drum for forming an electrostatic latent image on the surface thereof;

a charging device for electrifying the surface of the photoreceptor drum;

an exposure device for forming an electrostatic latent image on the photoreceptor drum surface;

a developing device for forming a toner image by supplying toner to the electrostatic latent image on the photoreceptor drum surface;

a transfer device for transferring the toner image on the photoreceptor drum surface to a recording medium; and, a fixing device for fixing the toner image to the recording medium, characterized in that the developing device employs the developing device defined in claim 5.

* * * * *